US007353766B1

(12) United States Patent
Wiese

(10) Patent No.: US 7,353,766 B1
(45) Date of Patent: Apr. 8, 2008

(54) MOVABLE CLEAT AND METHOD OF USE

(76) Inventor: Delbert C. Wiese, 520 Eleuthera La., Indian Harbour Beach, FL (US) 32937

( * ) Notice: Subject to any disclaimer, the term of this patent is extended or adjusted under 35 U.S.C. 154(b) by 0 days.

(21) Appl. No.: 11/607,721

(22) Filed: Dec. 4, 2006

(51) Int. Cl.
*B63B 21/04* (2006.01)

(52) U.S. Cl. ..... 114/218

(58) Field of Classification Search ..... 114/218, 114/219, 343, 364; 24/129 R, 129 B, 130; D8/356

See application file for complete search history.

(56) References Cited

U.S. PATENT DOCUMENTS 1,205,496 A * 11/1916 Whitehead ..... 24/129 R
3,913,875 A * 10/1975 Bruckmann ..... 248/539
4,895,094 A * 1/1990 Carlstedt ..... 114/218
5,210,911 A * 5/1993 Brown et al. ..... 24/18
7,143,708 B1 * 12/2006 Cimino ..... 114/219

* cited by examiner

*Primary Examiner*—Ed Swinehart
(74) *Attorney, Agent, or Firm*—Robert J. Van Der Wall

(57) ABSTRACT

The invention is an apparatus and method of use that involves a movable cleat on a boat. The movable cleat includes a base neck supporting two cleat arms above two cleat channels on both sides of the base neck, a base tunnel and two base apertures. One aspect of the invention involves use of the apparatus with a boat having a slotted toe rail around the periphery of the deck, from which is desired to be hung bumpers using the movable cleat and a bumper line at any desired point. The movable cleat may also be used elsewhere on a boat, especially a sailboat. Several such applications are to tie up the mainsail along the boom such as, but not limited to, when reefing, typing up a lowered head said to the life line, and tying up a lowered head sail to the toe rail.

4 Claims, 3 Drawing Sheets

MOVABLE CLEAT AND METHOD OF USE

BACKGROUND OF THE INVENTION

1. Field of the Invention

The present invention relates generally to the field of boating accessories, and specifically concerns an apparatus that is a movable cleat on a boat, particularly one having a toe rail that is perforated with slots around the periphery of a deck, from which is desired to be hung bumpers (also known as fenders). The method of use is included. The invention facilitates attaching a line from which is hung a bumper to the slotted toe rail at any desired point. The movable cleat may also be used elsewhere on a boat, especially a sailboat. Several such applications are to tie up the mainsail along the boom such as, but not limited to, when reefing, tie up a lowered head sail to the life line, and tie up a lowered head sail to the toe rail.

2. Description of the Prior Art

Many boats, especially sailboats, have a slotted toe rail around the periphery of the deck and a life (safety) line about two feet above it supported by stanchions. Bumpers are typically hung on one or two lines tied to the life line, one if the bumper is being used vertically, and two if the bumper is being used horizontally. This configuration is less than ideal because the life line was not designed to bear the strains that can develop if the bumper is subjected to large downward forces when caught between the boat hull and a dock or other adjoining structure. Alternatively, the bumper line may be tied to the stanchions, but that limits bumper location to the location of the stanchions, and there is no structure on a stanchion to which a bumper line is readily tied.

Generally cleats are fixedly attached to a boat hull at a point where lines are to be removably attached. For example, cleats are invariably placed at or near the stern and bow of a boat for attachment of dock lines on either or both sides of the stern and on the bow. The present invention differs with these types of cleats in that it is not fixedly attached to the boat, but is movable. It is designed to cooperate with the slotted toe rail for attaching bumper lines to the toe rail at any desired location, and also contains two apertures for attachment to a supporting line when applications other than with a cooperating toe rail are contemplated. A prior art search reveals no reference teaching a movable cleat, a cleat that cooperated with a slotted toe rail, a cleat for properly positioning a boat bumper, or a cleat for attachment to a line for such other applications as tying up excess sail when reefing a mainsail or as a sail stop on the boom when the mainsail is furled.

Although not even close to the present invention, the closest reference seems to be Skulnick, U.S. Pat. No. 6,752,098 for a Recessed Line Holder for a Boat Fender. This patent follows a parent, U.S. Pat. No. 6,435,122, for a Boat Fender. Other references along the same lines include Belvedere, U.S. Pat. No. 4,343,258, for a Boat Bumper; Dusek, U.S. Pat. No. 6,349,661 for a Boat Dock Bumper; Evans, et al., U.S. Pat. No. 4,198,919 for a Bumper Protection Device; Green, U.S. Pat. No. 4,584,958 for a Boat Bumper; Harvey U.S. Pat. No. 5,701,837 for a Boat Dock Bumper; Leonard et al., U.S. Pat. No. 6,332,421 for a Boat Fender System and Method; Patton, U.S. Pat. No. Des. 297,627 for a Boat Bumper; and a bit of fluff, Dietz, U.S. Pat. No. D456,323 for a Boat Bumper.

None of the foregoing either individually or collectively teach or suggest in any way the present invention.

SUMMARY OF THE INVENTION

Bearing in mind the foregoing, it is a principal object of the present invention to provide a cleat for attaching and properly positioning of a boat bumper both in horizontal and vertical axes.

Another principal object of the invention is to provide a cleat that cooperates with a slotted toe rail for proper positioning of a boat bumper.

A related principal object of the invention is to provide a cleat that cooperates a slotted toe rail to position a boat bumper in both a vertical configuration and a horizontal configuration.

An additional object of the invention is to provide a cleat that can be attached to a supporting line for cleating to another portion of that same line or another line, such as when tying off the mainsail along the boom when reefing or when the mainsail is furled, or when tying up a lowered head sail to a life line or toe rail.

A related object of the invention is to provide a cleat which contains two perforations for attachment of the cleat to a supporting line, such as a sail stop.

It is a further object of the present invention to provide all of the foregoing objects and advantages with a structure that is safe, lightweight, durable, corrosion preventing, strong, and inexpensive to manufacture and sell.

Other objects and advantages will become apparent to those skilled in the art upon reference to the following descriptions and the appended drawings.

In accordance with a principal aspect of the invention there is provided a movable cleat having a base neck supporting two cleat arms above two cleat channels on both sides of the base neck, a base tunnel and two base apertures. When used with a cooperating slotted toe rail, the base tunnel is aligned with the desired slot in the toe rail, the bumper line is passed through the slot and base tunnel, then passed through a first cleat channel underneath a first cleat arm, then through a second cleat channel underneath a second cleat arm, then underneath the portion of the bumper line disposed between the first and second cleat channels and pulled snug. In short the bumper line is cleated off on the cleat arms as with a conventional cleat.

In accordance with another aspect of the invention, when used without the slotted toe rail, first end of the supporting line is passed through a first base aperture and then tied off against itself using two half hitches or a bowline or a running bowline. The supporting line is then passed around a bundle such a furled sail, then through the second base aperture, then through a first cleat channel underneath a first cleat arm, then around the cleat neck and over the top of the second cleat arm, then behind the second cleat arm, then through the second cleat channel underneath the second cleat arm, and finally underneath the segment of the supporting line between the first cleat channel and the top of the second cleat arm and pulled snug. In short, the supporting line is cleated off as with a conventional cleat.

BRIEF DESCRIPTION OF THE DRAWINGS

Various other features of the invention will become apparent to those skilled in the art from the following discussion taken in conjunction with the appended drawings, in which.

DETAILED DESCRIPTION OF THE PREFERRED EMBODIMENTS

Figure 1:
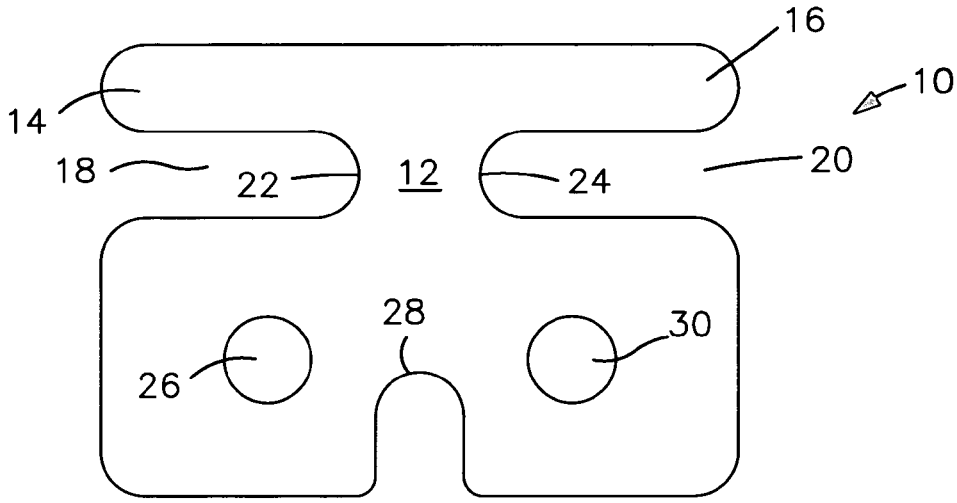
FIG. 1 is a front elevation view of the preferred embodiment of the invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

FIG. 1 is a front elevation view of the preferred embodiment of the invention showing a movable cleat 10 having a base neck 12 supporting a first cleat arm 14 and a second cleat arm 16. The cleat arms 14, 16 are disposed respectively above a first cleat channel 18 and a second cleat channel 20 on either side of the base neck 12. First cleat channel 18 terminates in first cleat channel root 22 and second cleat channel 20 terminates in second cleat channel root 24. Arrayed left to right beneath the foregoing are a first base aperture 26, a base tunnel 28 and a second base aperture 30.

Figure 2:
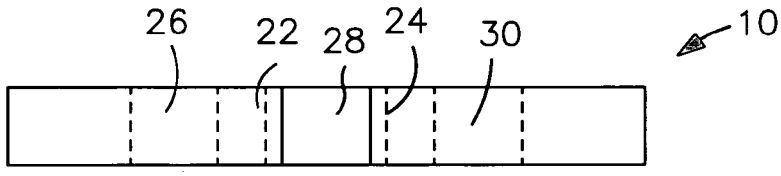
FIG. 2 is a bottom view of the invention.

FIG. 2 is a bottom view of the invention 10 showing the base tunnel 28, the first base aperture 26 in phantom, the second base aperture 30 in phantom, first cleat channel root 22 in phantom and second cleat channel root 24 in phantom.

Figure 3:
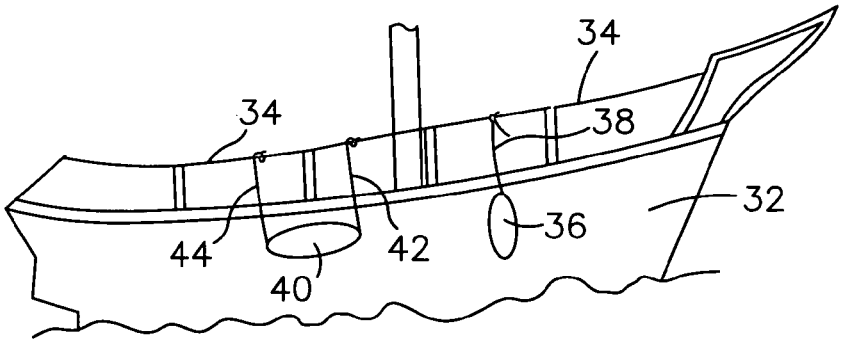
FIG. 3 PRIOR ART
FIG. 3 is a broken view of a sailboat showing the prior art technique of tying bumper lines to the life line in both vertical and horizontal configurations.

FIG. 3 is a broken view of a sailboat 32 showing the prior art technique of tying bumper lines to the life line 34. Seen are vertical bumper 36 hung from a single bumper line 38 and horizontal bumper 40 hung from two bumper lines 42 and 44.

Figure 4:
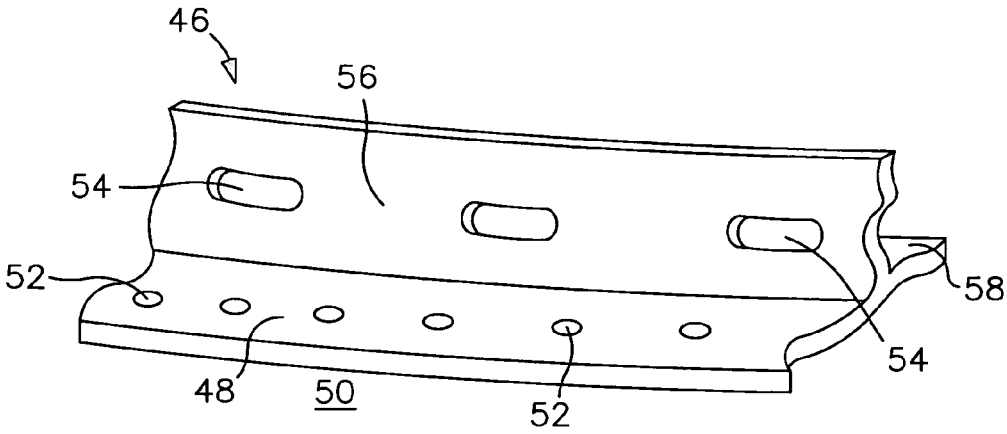
FIG. 4 PRIOR ART
FIG. 4 is a broken perspective view of the slotted toe rail of the prior art.

FIG. 4 is a broken perspective view of the slotted toe rail 46 of the prior art. Seen are inner flange 48 attached to the boat deck 50 using bolts 52, slots 54 disposed in web 56 and outer flange 58.

Figure 5:
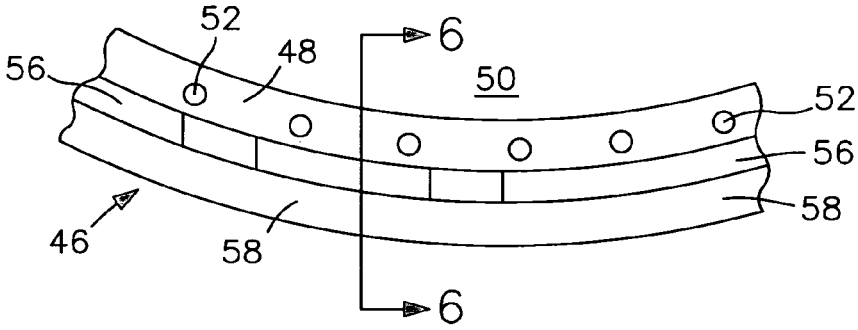
FIG. 5 PRIOR ART
FIG. 5 is a broken top view of the slotted toe rail of the prior art.

FIG. 5 is a broken top view of the slotted toe rail 46 of the prior art. Seen are inner flanges 48 attached to the boat deck 50 using bolts 52, web 56 and outer flange 58. Slots 54 are seen in phantom through web 56.

Figure 6:
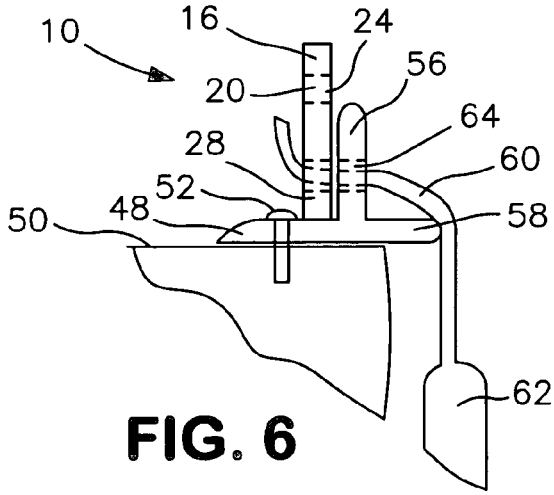
FIG. 6 is a broken cross section view taken along the line 6-6 of FIG. 5 and showing the bumper line inserted through a slot in the toe rail and through the base tunnel of the invention.

FIG. 6 is a broken cross section view taken along the line 6-6 of FIG. 5 and showing the bumper line 60 of bumper 62 inserted through a slot 64 in the toe rail web 56 and through the base tunnel 28 of the invention 10. Also seen are second cleat arm 16, second cleat channel 20, second cleat channel root 24, inner flange 48, outer flange 58, bolt 52 and boat deck 50.

Figure 7:
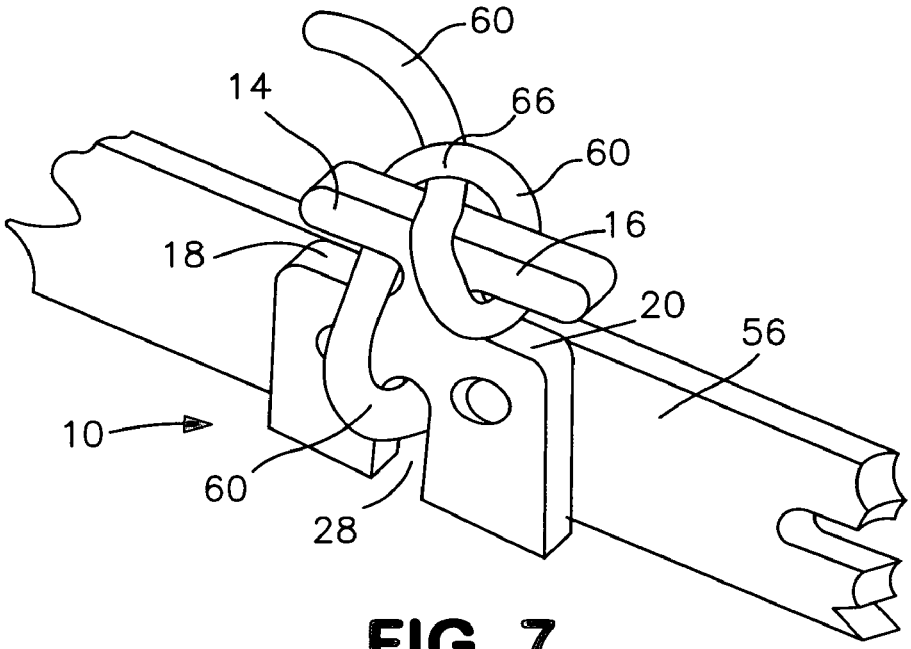
FIG. 7 is a perspective view of the invention against a broken view of the slotted toe rail web.

FIG. 7 is a perspective view of the invention 10 against a broken view of the slotted toe rail web 56 and showing how bumper line 60 is applied to and cleated on the movable bumper cleat 10. Specifically, the bumper line 60 is passed through the slot (not seen in this view, see FIG. 6) and base tunnel 28, then passed through a first cleat channel 18 underneath a first cleat arm 14, then through a second cleat channel 20 underneath a second cleat arm 16, then underneath the portion 66 of the bumper line 60 disposed between the first cleat channel 18 and second cleat channel 20 and pulled snug.

Figure 8:
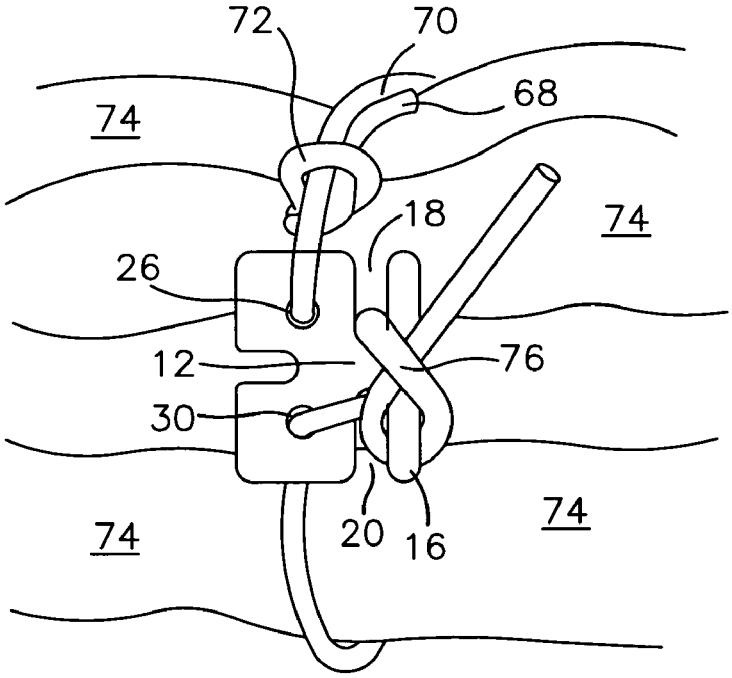
FIG. 8 is a top view of the invention when used independently of the slotted toe rail such as a sail stop.

Turning finally to FIG. 8 a top view of the invention when used independently of the slotted toe rail such as a sail stop is seen. A first end 68 of a supporting line 70 is passed through the first base aperture 26 and then tied off against itself using two half hitches or a bowline 72 or a running bowline. The supporting line 70 is then passed around a bundle 74 such a furled sail, then through the second base aperture 30, then through a second cleat channel 20 underneath a second cleat arm 16, then around the back of the cleat neck 12, then through a first cleat channel 18 and over the top of the second cleat arm 16, then behind the second cleat arm 16, then through the second cleat channel 20 underneath the second cleat arm 16, and finally underneath the segment of the supporting line between the first cleat channel and the top of the second cleat arm 76 and pulled snug. In short, the supporting line is cleated off as with a conventional cleat.

While the invention has been described, disclosed, illustrated and shown in various terms or certain embodiments or modifications which it has assumed in practice the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A method of use of a movable cleat having a base neck supporting two cleat arms above a first and a second cleat channel on both sides of the base neck, and a base tunnel when used with a cooperating slotted toe rail, the base tunnel is aligned with a desired slot in the toe rail, a bumper line is passed through the slot and base tunnel, then cleated off and pulled snug.

2. The method of use of claim 1 in which cleated off and pulled snug further comprises after the bumper line is passed through the base tunnel it is passed underneath a first cleat arm, then underneath a second cleat arm, then underneath a portion of the bumper line disposed between the first and second cleat arms before being pulled snug.

3. The method of use of claim 1 which further comprises: and another method of use of a movable cleat having a base neck supporting two cleat arms above on both sides of the base neck, and a first and a second base aperture when used without a slotted toe rail, a first end of a supporting line is passed through the first base aperture and then tied off against itself, the supporting line is then passed around a bundle, then through the second base aperture, then cleated off and pulled snug.

4. The method of use of claim 3 in which a second instance of cleated off and pulled snug further comprises after the supporting line is passed around the bundle and through the second base aperture it is passed underneath a second cleat arm, then around the cleat neck then underneath a second arm, then and over the top of the second cleat arm, then behind the second cleat arm, then underneath the second cleat arm, and finally underneath a segment of the supporting line between underneath the first cleat arm and a top of the second cleat arm before being pulled snug.

* * * * *